United States Patent [19]

Munger

[11] Patent Number: 4,584,582

[45] Date of Patent: Apr. 22, 1986

[54] MULTI-MODE DIRECTION FINDING ANTENNA

[75] Inventor: Archer D. Munger, Scottsdale, Ariz.

[73] Assignee: Motorola, Inc., Schaumburg, Ill.

[21] Appl. No.: 297,818

[22] Filed: Aug. 31, 1981

[51] Int. Cl.[4] ..... H01Q 3/22; H01Q 3/24; H01Q 3/26

[52] U.S. Cl. ..... 343/373; 343/742; 343/845

[58] Field of Search ..... 343/847, 846, 848, 854, 343/742, 845

[56] References Cited

U.S. PATENT DOCUMENTS 3,718,935 2/1973 Ranghelli et al. ..... 343/846

4,213,132 7/1980 Davidson ..... 343/854

4,309,706 1/1982 Mosko ..... 343/895

*Primary Examiner*—Eli Lieberman

*Attorney, Agent, or Firm*—Eugene A. Parsons

[57] ABSTRACT

An antenna having more than four elements positioned in a predetermined regular pattern with equal angles between adjacent elements and a mode former connected to the elements to shift signals from the elements by first equal electrical angles and superimposing the signals to provide a first output mode and shifting the signals by second equal electrical angles and superimposing the signals to provide a second output mode, the two output modes providing sufficient information to determine the direction of the radiated signal impinging on the antenna.

11 Claims, 4 Drawing Figures

MULTI-MODE DIRECTION FINDING ANTENNA

BACKGROUND OF THE INVENTION

Active and passive monopulse direction finding systems have been successfully designed for many years when the available space for the antenna has been on the order of a wavelength or larger. Two direction finding systems generally used are the four element monopulse and the dual mode monopulse systems. The present invention deals with the dual mode monopulse system.

The dual mode direction finding technique is typically implemented by means of a four arm dual mode spiral antenna. This technique forms a circularly polarized, circularly symmetric sum pattern when excited for mode one and a circularly polarized, circularly symmetric difference pattern when excited for mode two. Amplitude comparison of the modes one and two gives the angle $\theta$ from the z axis. Phase comparison of modes one and two gives the angle $\phi$ about the z axis.

At frequencies below 1 GHz, the dual mode spiral antenna design is severely limited because the reduced size antenna aperture results in a narrow bandwidth, sensitivity to polarization, and poor accuracy. Attempts to reduce the size of a four spiral element monopulse antenna encounter element to element coupling and coupling to the ground plane structure which indicate that this approach is not feasible for applications requiring size reduction substantially below a one wavelength diameter. The present invention deals with the problem of an antenna which can provide accurate, broadband, all polarization direction finding at VHF through UHF frequencies in space-limited applications such as missiles, drones, RPV, and small aircraft. Because of space limitations, the total aperture size is much less than a wavelength demanding use of reduced size or electrically small antennas, and creating a need for extreme phase and/or amplitude accuracies in order to achieve acceptable angle accuracies. The use of an electrically small aperture makes it especially difficult to achieve both acceptable gain and high phase and amplitude balance over broadbands. Also, the small aperture antenna couple strongly to the airframe, with a resulting deterioration of antenna patterns and of derived angle information.

SUMMARY OF THE INVENTION

The present invention pertains to a multimode direction finding antenna including more than four elements positioned in a predetermined regular pattern with the longitudinal axes of all adjacent elements forming equal angles and a mode former connected to each of the elements for electrically shifting signals from adjacent elements by first equal electrical angles and providing a superposition (or vector summation) of all the shifted signals at a first, or sum, mode output, and electrically shifting signals from the elements by second equal electrical angles, different than the first electrical angle, and providing a superposition of all the shifted signals at a second, or difference, mode output.

It is an object of the present invention to provide a new and improved multi-mode direction finding antenna.

It is a further object of the present invention to provide a multi-mode direction finding antenna which can be reduced in size substantially below a wave length in diameter while still maintaining adequate operating characteristics.

It is a further object of the present invention to provide a multi-mode direction finding antenna capable of providing sum and difference mode signals in opposite circular polarizations.

These and other objects will be apparent to those skilled in the art upon consideration of the accompanying specification, claims and drawings.

BRIEF DESCRIPTION OF THE DRAWINGS

Referring to the drawings.

DESCRIPTION OF THE PREFERRED EMBODIMENTS

Figure 1:
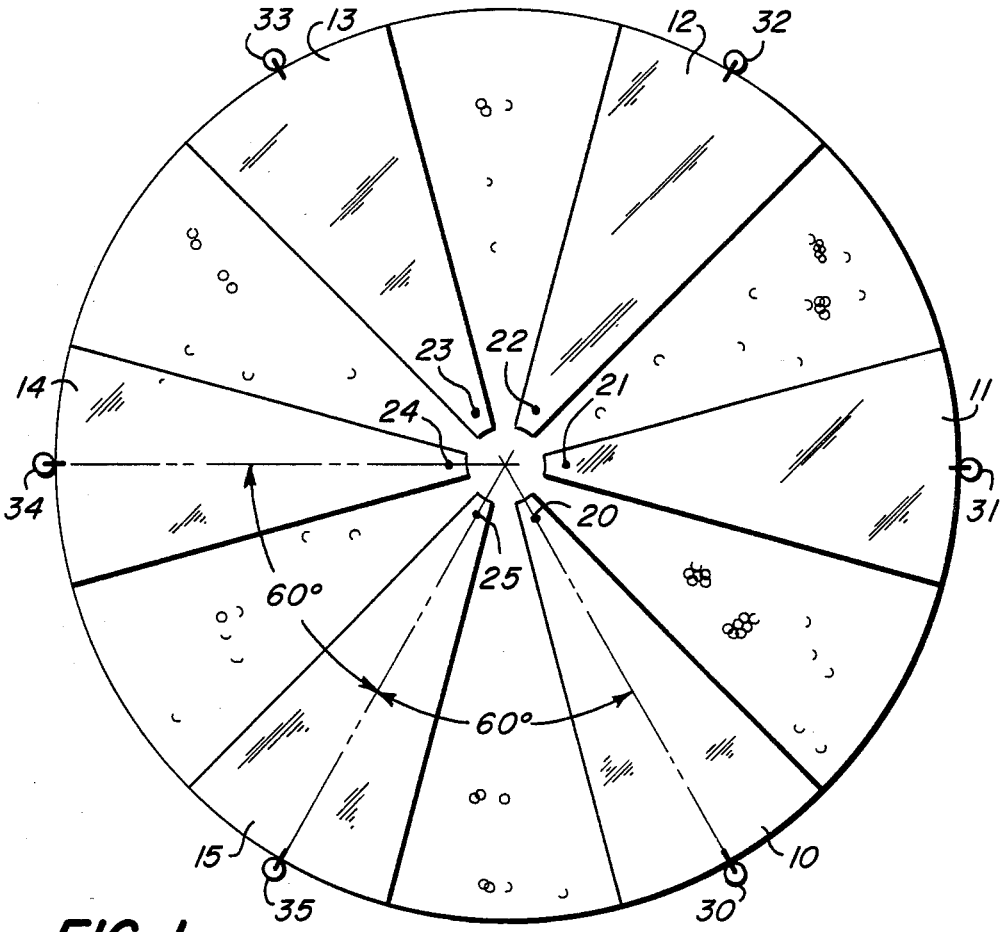
FIG. 1 is a view in top plan of an antenna embodying the present invention.
Figure 2:
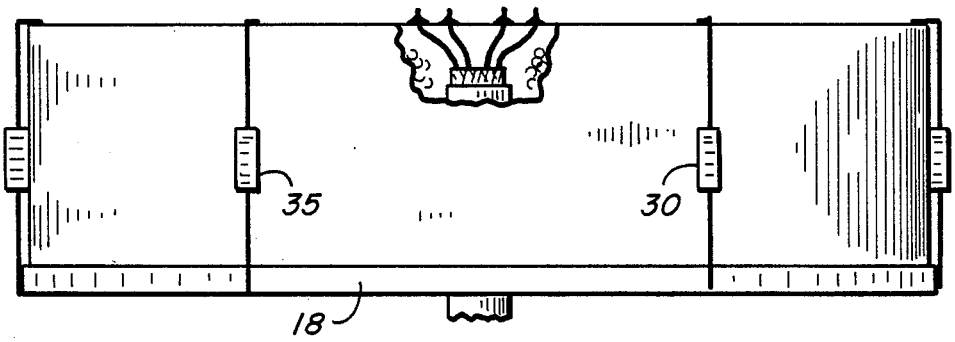
FIG. 2 is a view in side elevation of the antenna illustrated in FIG. 1.

Referring specifically to FIGS. 1 and 2, an antenna including six elements 10–15 arranged on equal angular radials of a circle and spaced over a ground plane 18 is illustrated. In this embodiment, each of the elements 10–15 is generally wedge shaped with a longitudinal axis thereof lying generally along a radius of the circle. Because the antenna includes six elements, the angle between the longitudinal axis thereof is approximately 60°. It will of course be understood that if five elements were utilized the angles between adjacent longitudinal axes would be approximately 72°, if seven elements were used the angles would be approximately 51.5°, eight elements require 45° angles, etc. Each element 10–15 is fed at a point 20–25, respectively, adjacent the inner end thereof. The connection of the feed points 20–25 to the remainder of the circuitry may be made, for example, by six coaxial cables with the inner conductors attached to the feed points 20–25 and the outer conductors grounded. The six coaxial cables can be seen generally in FIG. 2 but the connections to the elements 10–15 will be referred to by the feed points 20–25 throughout this description. It should be understood that any coupling means, such as a transmission line, six wires, etc. could be used.

If two conductor transmission lines are used for coupling the antenna elements, the currents in the conductor not connected to the element are cancelled by its proximity to the other feed points. If single conductor coupling is used, all of the conductors cooperate to form a transmission line and reduce unwanted current. Thus, the centrally located feed points are self-balancing and reduce the effects of the mounting structure.

In the embodiments illustrated in FIGS. 1 and 2, the ground plane 18 is spaced from the elements 10–15 and lies in a plane parallel with a plane passing through each of the elements 10–15. The outer edge of each element 10–15 is terminated with an impedance 30–35, respectively, connected between the outer edge and the ground plane 18. The impedances 30–35 may be, for example, one or more resistors, capacitors, etc. which provide impedance matching of the antenna elements 10–15. The circuitry connected to the feed points 20–25 isolates the impedance of each of the elements 10–15 but the isolation is finite and, thus, the impedance matching provided by the impedances 30–35 help to match each arm to the additional circuitry. The antenna elements 10–15, the impedances 30–35 and the ground plane 18 can be considered to form six loops if desired.

In the embodiment illustrated the wedge shaped elements 10–15 are formed of an electrically conductive material, such as copper, and the ground plane 18 is formed of an electrically conductive material, such as aluminum, copper, or the skin of a vehicle carrying the antenna. The diameter of the antenna is approximately 1/7 of a wave length at the lowest operating frequency. To add to the mechanical stability of the antenna illustrated in FIGS. 1 and 2, foam spacing material is inserted between the ground plane 18 and the elements 10–15. It will be understood by those skilled in the art that any suitable type of dielectric material might be utilized in the space between the elements and the ground plane and that the dielectric material chosen can improve the characteristics of the antenna.

Figure 3:
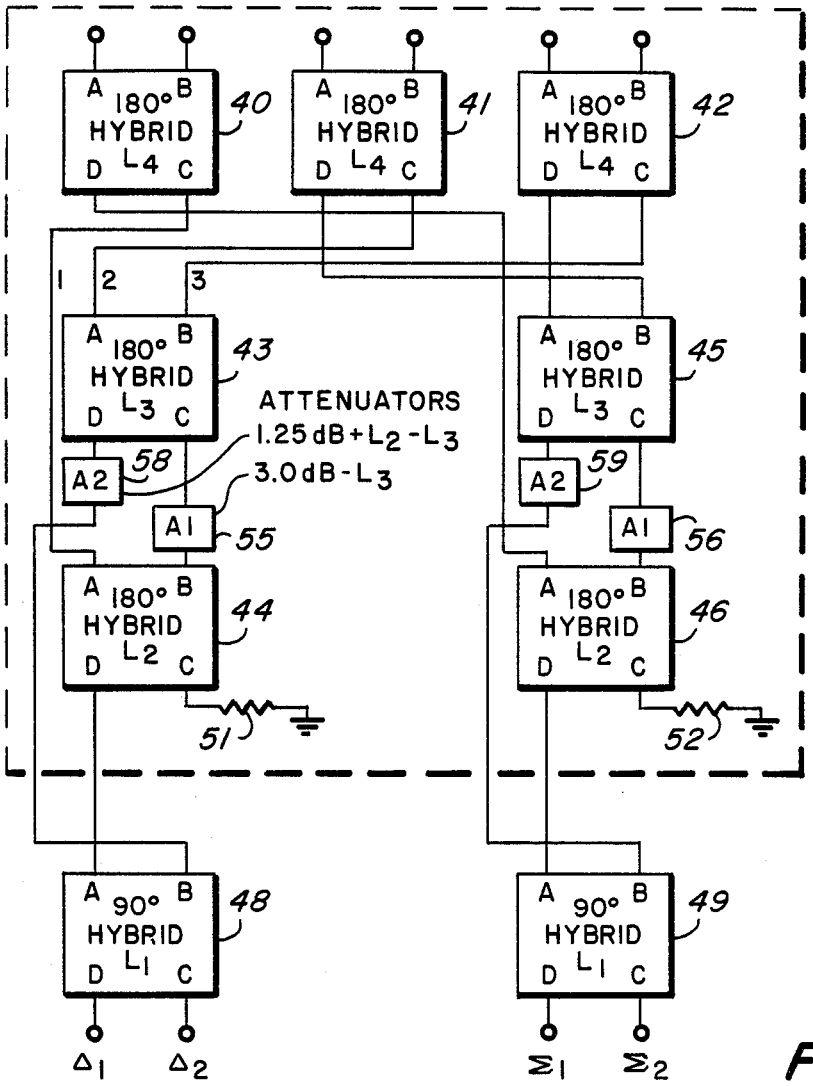
FIG. 3 is block diagram of a mode former to be used in conjunction with the antenna of FIG. 1 and embodying a portion of the invention.

Referring specifically to FIG. 3, a block diagram of a six way mode former is illustrated. The six way mode former of FIG. 3 is connected to the feed points 20–25 of the antenna by way of the coaxial cables. It will of course be understood that the six way mode former can be positioned immediately adjacent the antenna or can be remotely positioned if desired. The mode former includes seven 180° hybrid devices 40–46 and two 90° hybrid devices 48 and 49. The hybrid devices 40–46 and 48 and 49 may be any of the well known devices, including a wave guide top wall or side wall coupler, a branch line coupler in wave guide, coax, strip line, a strip line parallel line coupler, a magic T or any of a number of coupler types which have the property of providing two outputs differing in phase by 180° or 90°, and conversely of coupling all the power to one of two isolated ports when power is applied equally to two other ports with a 180° or 90°, phase differential. The hybrid devices operate in a manner well known to those skilled in the art and generally as follows. A signal fed to one of the four ports is divided into two equal output signals appearing at the opposite ports. The output signals differ in relative phase by 180° for the hybrids 40–46 and 90° for the hybrids 48 and 49, with the output port diagonally opposite the input port having the greatest delay. For example, a signal fed in at a port A is coupled equally to ports C and D, with the signal delivered to port C delayed 180° (for devices 40–46) and 90° (for devices 48 and 49) in phase with respect to the signals delivered to port D.

The A and B input ports of the hybrid 40,41 and 42 form six inputs to the mode former and are connected to the elements of the antenna associated therewith. In this embodiment ports A and B of hybrid 40 are connected to elements 10 and 13, respectively. Ports A and B of hybrid 41 are connected to elements 14 and 11, respectively. Ports A and B of hybrid 42 are connected to elements 12 and 15, respectively. The following direct connections are made between the designated ports; port C of hybrid 40 to port A of hybrid 44, port D of hybrid 40 to port A of hybrid 46, port C of hybrid 41 to port A of hybrid 43, port D of hybrid 41 to port B of hybrid 45, port C of hybrid 42 to port B of hybrid 43, port D of hybrid 42 to port A of hybrid 45, port D of hybrid 44 to port A of hybrid 48, and port D of hybrid 46 to port A of hybrid 49. Port C of hybrid 44 is terminated in a matched load 51 and port C of hybrid 46 is terminated in a matched load 52. Port C of hybrid 43 is connected through an attenuator 55 to port B of hybrid 44. Port C of hybrid 45 is connected through an attenuator 56, similar to attenuator 55, to port B of hybrid 46. Port D of hybrid 43 is connected through an attenuator 58 to port B of hybrid 48. Port D of hybrid 45 is connected through an attenuator 59, similar to attenuator 58, to port B of hybrid 49. Ports C and D of the hybrids 48 and 49 are four mode outputs.

Hybrids 45, 46 and 49 form a first leg which, in conjunction with hybrids 40, 41 and 42 form a first configuration for phase shifting the input signals and providing a superposition or vector summation thereof at the mode outputs of the hybrid 49. The mode outputs at the ports C and D of the hybrid 49 are both sum mode outputs, but one is opposite polarization of the other, i.e., one appears right hand circular polarized and the other appears left hand circular polarized. Hybrids 43, 44 and 48 form a second leg of the mode former and, in conjunction with hybrids 40, 41 and 42, form a second configuration which phase shifts the signals from the antenna elements by a different amount and provides superposition of the signals at the two mode outputs. The mode outputs from the ports D and C of hybrid 48 are both difference mode outputs but one is the opposite polarization of the other, i.e., right hand circular polarized and left hand circular polarized. In the present embodiment the first configuration of the mode former shifts the signal from each element of the antenna, relative to the previous adjacent element, by an equal angle, i.e., 60°, producing a 60° phase progression which results in a sum mode with on axis circular polarization. The axis referred to is the Z axis wh1ch extends through the center of the antenna and perpendicular to the plane thereof. The second configuration of the mode former shifts a signal on each element, relative to the previous adjacent element, by 120° (in this 6 element antenna) to produce a phase progression which results in a difference mode with circular polarization near the on axis null. The chart below illustrates the angular progress for each of the modes.

| | Element | | | | | |
|---|---|---|---|---|---|---|
| Mode | 10 | 11 | 12 | 13 | 14 | 15 |
| M = 1 | 0° | 60° | 120° | 180° | −120° | −60° |
| M = −1 | 0° | −60° | −120° | 180° | 120° | 60° |
| M = 2 | 0° | 120° | −120° | 0° | 120° | −120° |
| M = −2 | 0° | −120° | 120° | 0° | −120° | 120° |

The mode former normally would incorporate a 180° un-equal power divider in place of hybrids 44 and 46, but so that standard parts can be utilized, i.e., 180° hybrids, a 3 db attenuation must be inserted in the connections. In addition, practical implementation requires matching the insertion loss and insertion phase of the cables which by-pass the hybrid device. In the present embodiment both the 180° hybrid devices and the attenuators utilized have an insertion phase which is linear with frequency to within a few degrees. Thus, phase compensation is possible by adjusting the length of connecting lines. The specific attenuators utilized are compact inline coaxial mounted TEE pads which exhibit nearly constant attenuation over the band and a linear phase versus frequency characteristic. The attenuators 55 and 56 have an attenuation of 3.0 db$-L_3$ (where $L_3$ is the loss of either of hybrids 43 or 45). The attenuators 58 and 59 have an attenuation of 1.25 db plus $L_2$–$L_3$ (where $L_2$ is the attenuation of either of the hybrids 44 or 46). The 180° hybrids are commercially available devices which exhibit excellent amplitude and phase balance. The insertion phase of these devices is linear with frequency such that phase paths could be compensated with transmission line lengths. Several 90° hybrid devices are commercially available, which devices cover different portions of the band. These devices may either be combined to cover a wide band or a broadband hybrid can be used.

Figure 4:
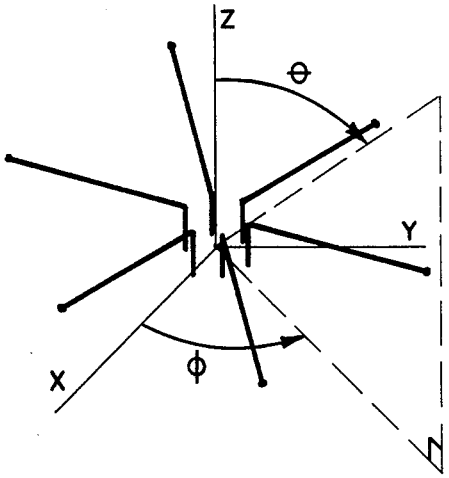
FIG. 4 illustrates a different antenna embodiment of the present invention.

Referring specifically to FIG. 4, a different multi-element antenna is illustrated, which may be substituted for the antenna embodiment illustrated in FIG. 1. The antenna of FIG. 4 includes six elements of uniform cross-section, generally connected as described for the embodiment of FIG. 1. The ground plane is optional and may be present in the X Y plane or not, as dictated by the particular application.

The antenna is suitable for use as a direction finding antenna in conjunction with a suitable mode former as disclosed herein and the direction finding information can be obtained from mode patterns, $M=1$ and $M=2$, previously disclosed. If enough elements are present, greater than 4, the mode 1 pattern has circular polarization near the axis Z and a uniform 0° to 360° phase variation as a function of the angle $\phi$. As seen in FIG. 4, the angle $\theta$ indicates the direction of the incoming signal from the Z axis and the angle $\phi$ indicates the direction of the signal about the Z axis in a counter clockwise direction (as seen from above) from the X axis. The mode 2 pattern has circular polarization near the Z axis, an on-axis null, and a 0° to 720° phase variation as a function of $\phi$. The angle $\theta$ is obtained by amplitude comparison of modes one and two which is the output signals from the ports D (or, inversely, ports C) of the hybrids 48 and 49. The angle $\phi$ is obtained by phase comparison of modes 1 and 2 (or, inversely, modes $-1$ and $-2$), the phase difference being equal to the angle $\phi$. The antenna and the mode former disclosed herein provide the modes 1 and 2, or the negatives thereof, and the amplitude comparison and phase comparison calculations are performed by receiver equipment not shown. Since this receiver equipment is well known in the art and has been used previously with dual mode spiral antennas, it is not necessary to illustrate this equipment in detail herein. The antenna disclosed herein, in conjunction with a mode former, has characteristics superior to those of a dual mode spiral antenna when operated as an electrically small aperture. This is particularly true when used in the absence of a large ground plane, as would be the case when the antenna is used on a small airframe.

Thus, improved antennas and associated mode formers are illustrated for use in direction finding equipment, which are superior to previous antennas known in the art. The total aperture size of the improved antennas is much less than a wave length with the mechanical and electrical size of the antennas being substantially reduced over prior art devices. In spite of the small aperture, the present antennas have achieved acceptable gain and high phase and amplitude balance over broad bands. Also, they provide phase and/or amplitude accuracies which result in acceptable angle accuracies.

While I have shown and described specific embodiments of this invention, further modifications and improvements will occur to those skilled in the art. I desire it to be understood, therefore, that this invention is not limited to the particular forms shown and I intend in the appended claims to cover all modifications which do not depart from the spirit and scope of this invention.

I claim:

1. A multi-mode direction finding antenna comprising:

(a) more than four elements positioned in a predetermined regular pattern, each of said elements having a longitudinal axis with the axes of all adjacent elements forming equal angles;

(b) mode forming means having an input for each of said elements and two mode outputs, one mode output for a sum mode signal and one mode output for a difference mode signal; and (c) coupling means coupling each one of said elements to a different one of the inputs of said mode forming means.

2. An antenna is claimed in claim 1 wherein six elements are included each having a feed point adjacent one end and all of said elements are positioned with the feed points centrally located and the elements radiating outwardly therefrom.

3. An antenna as claimed in claim 1 wherein each element is generally wedge shaped.

4. An antenna as claimed in claim 1 having in addition a ground plane in spaced relation from the elements and parallel to a plane through all of the elements.

5. An antenna as claimed in claim 4 wherein the end of each element opposite the feed point is electrically connected to the ground plane by impedance matching means.

6. An antenna as claimed in claim 5 wherein each element and the associated impedance matching means forms a loop with the ground plane.

7. An antenna as claimed in claim 1 wherein the diameter of the antenna is substantially less than a wavelength at the operating frequency.

8. An antenna as claimed in claim 1 wherein the mode forming means includes a plurality of hybrid devices some of which are connected in a first configuration to electrically shift signals on adjacent elements by first equal electrical angles and provide a superposition of all the signals at a first mode output and some of which are connected in a second configuration to electrically shift signals on adjacent elements by second equal electrical angles, different than the first electrical angles, and provide a superposition between all of the signals at a second mode output.

9. An antenna as claimed in claim 8 wherein six monopole elements are included and the first electrical angles are each 60° and the second electrical angles are each 120°.

10. An antenna as claimed in claim 8 wherein the first and second mode outputs provide signals representative of a first circular polarization, and the mode forming means includes two more outputs for providing mode signals thereon representative of a second circular polarization, opposite the first polarization.

11. A multi-mode direction finding antenna comprising:

(a) six monopole elements each having a longitudinal axis with the elements fixedly positioned so the longitudinal axes thereof radiate outwardly with approximately 60° between adjacent longitudinal axes; and (b) mode forming means having six inputs, each one connected to a different one of said antenna elements, and two mode outputs, said mode forming means including a first portion for electrically shifting signals from adjacent antenna elements sixty electrical degrees and providing a superposition of all six signals at a first one of the mode outputs and a second portion for electrically shifting signals from adjacent antenna elements one hundred and twenty electrical degrees and providing a superposition of all six signals at a second one of the mode outputs.

* * * * *